US005092558A

United States Patent [19]

Katsura

[11] Patent Number: 5,092,558

[45] Date of Patent: Mar. 3, 1992

[54] METAL MOLD HAVING A CERAMIC COATING FOR FORMING SINTERED PART

[75] Inventor: Akio Katsura, Itami, Japan

[73] Assignee: Sumitomo Electric Industries, Ltd., Osaka, Japan

[21] Appl. No.: 568,522

[22] Filed: Aug. 13, 1990

Related U.S. Application Data

[63] Continuation of Ser. No. 268,973, Nov. 9, 1988, abandoned.

[30] Foreign Application Priority Data

Nov. 10, 1987 [JP] Japan ..... 62-284050

[51] Int. Cl.[5] ..... B22F 3/00; B29C 33/56

[52] U.S. Cl. ..... 249/114.1; 249/135; 264/338; 427/135

[58] Field of Search ..... 249/114.1, 115, 116, 249/135; 425/78; 264/337, 338; 427/133, 135

[56] References Cited

U.S. PATENT DOCUMENTS 4,120,930 10/1978 Lemelson ..... 249/114.1
4,142,888 3/1979 Rozmus ..... 249/135
4,546,951 10/1985 Boschman ..... 249/115
4,721,518 1/1988 Monji et al. ..... 249/116

FOREIGN PATENT DOCUMENTS 59-179311 10/1984 Japan ..... 249/135
60-118638 6/1985 Japan ..... 249/135
63-153112 6/1988 Japan ..... 249/135
2155843 10/1985 United Kingdom ..... 249/135

*Primary Examiner*—James C. Housel
*Attorney, Agent, or Firm*—Wenderoth, Lind & Ponack

[57] ABSTRACT

Ceramic coated metal mold having a constant ceramic film thickness, which is superior in adhesion resistance and abrasion resistance, prepared by coating the inside and outside walls of a metal mold with ceramics, by the physical vapor deposition method. The ceramic coating is selected from one of TiC, TiN, and TiCN. The mold surfaces to which the coating is applied has a surface roughness of 1 S or less and the end corners have a radius R of 0.1–0.3 mm, to provide adhesion between the metal mold and the ceramic coating.

3 Claims, 1 Drawing Sheet

METAL MOLD HAVING A CERAMIC COATING FOR FORMING SINTERED PART

This application is a continuation of now abandoned application Ser. No. 07/268,973 filed on Nov. 9, 1988.

DETAILED DESCRIPTION OF THE INVENTION

1. Field of the Invention

The present invention relates to an improvement in a metal mold used for molding or coining or sizing a sintered part of iron series or copper series.

2. Prior Arts and Problems Thereof

Sintered alloys have comprised iron powders or copper powders as the base and various kinds of alloy additive and lubricant and have been produced by (1) molding and sintering, or (2) coining or (3) sizing after sintering.

And, of these methods the molding method (1), the coining method (2) and the sizing method (3) have generally used a metal mold formed of materials such as (1) alloyed tool steels, high-speed steels and the like subjected to the heat treatment and (2) carbide alloys.

However, powders, such as iron powders and copper powders, are molded under high pressure, so that the inside and outside walls of the metal mold brought into contact with the product exhibit one kind of sticking and fast wear and tear, and thus, a disadvantage occurs in that a life of the metal mold is remarkably short in comparison with that of other die cast parts and molded parts formed of resins and the like.

So, in the case where the metal mold formed of alloyed tool steels and high-speed steels is used, the inside and outside walls of said metal mold have been subjected to the treatments, such as (1) hard chromium plating treatment, (2) hardening treatment such as tuftride and ion nitrification, (3) coating with TiC by the CVD method, (4) surface treatment by the sulfuration and the like and (5) other surface treatment, to improve the abrasion resistance and sticking resistance. In addition, the abrasion resistance and sticking resistance have been given by using carbide alloys as the material of the metal mold.

However, of the above described conventional surface treatments, methods other than the CVD method (3) showed the maximum Micro Vickers Hardness of 1,300 mHv.

And, since the film-thickness of the film coated on the inside and outside walls of the metal mold can not be controled in every treatment method of the above described treatment methods (1) to (5), at present the metal mold has been machined prior to the above described treatment in anticipation of the film-thickness of the coated film, which was previously anticipated as the preliminary treatment for the metal mold, and a machining allowance for correcting said film-thickness of the coated film and the correction machining has been carried out again after the coating to secure the desired accuracy.

MEASURES FOR SOLVING THE PROBLEMS

The present invention has been achieved in view of the above described points. It has been found from investigation of the treatment for the inside and outside walls of the metal mold which is capable of giving a highly accurate film-thickness, superior abrasion resistance and sticking resistance and a long life to the metal mold, that the highly abrasion resistant metal mold having the constant film-thickness and the density and strength, which can withstand the powder molding, can be obtained by applying ceramics to the inside and outside walls of the metal mold by the physical deposition method (PVD method).

Thus, the present invention provides a metal mold for forming tools for powder metal parts, said mold being formed of alloyed tool steels, said mold having substantially concentric inner and outer surfaces and a castellated top surface connecting said inner and outer surfaces, said castellated top surface defining protrusions with end corners, wherein said inner and outer surfaces and said end corners of said metal mold are coated with a ceramic selected from the group consisting of Ti carbide, Ti nitride and Ti carbonitride by a PVD method to improve the abrasion resistance of said metal mold and wherein the finishing surface roughness of said inner and outer surfaces of said mold to which said coating is applied is 1 S or less and a radius R of 0.1 to 0.3 mm. is given to said end corners of said metal mold to which said coating is applied to provide adhesion between the alloyed tool steel and the ceramic coating.

BRIEF DESCRIPTION OF THE DRAWINGS

FIGS. 1 to 4 are perspective views showing a metal mold coated with ceramics according to the present invention, in which FIG. 1 is a perspective view showing a metal mold for use in an involute gear made of carbide alloys;

FIG. 2 is a perspective view showing a blade type core made of high-speed steels;

FIG. 3 is a perspective view showing a core made of high-speed steels for use in a pipe; and FIG. 4 is a perspective view showing a punch made of carbide alloys.

OPERATION

Figure 1:
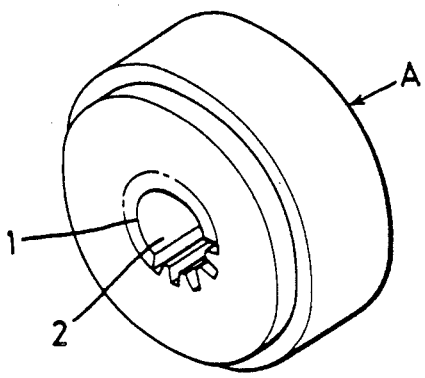
Figure 2:
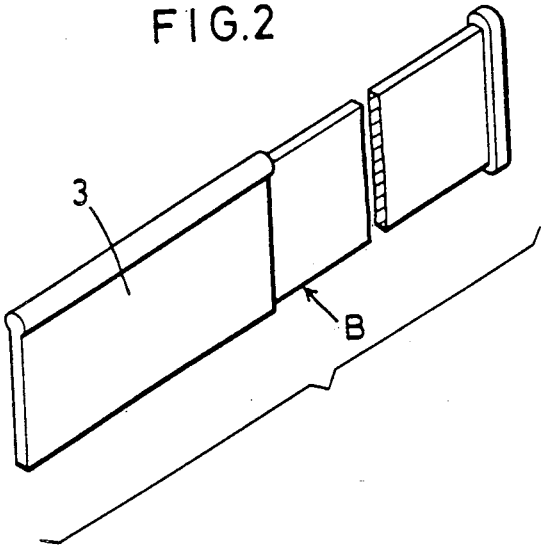

The invention will be below described in detail.

The present inventor has found that the following problems occur in coating the inside and outside walls of the metal mold with ceramics:

(1) The pressure in the molding or coining or sizing of the sintered body is generally 2 t/cm$^2$ or more. Accordingly, the film adherence strength of ceramics to the metal mold must be 2 t/cm$^2$ or more, or else the coated film will be separated.

(2) Since ceramics are different from the basic material of the metal mold in toughness, in the case where the compression and tensile stress in the basic material corresponding to the pressing and ejection repeated for example during the molding or coining or sizing are remarkably large, slip-separation occurs.

(3) The treatment by the PVD method is carried out at temperature of 250° to 550° C., so that the hardness is lowered and the size is changed for some kinds of basic material, and the like.

As a result of awareness of the following points as measures for solving the above described problems, as above described, the metal mold, of which the inside and outside walls are formed of mother metals, such as alloyed tool steels, high-speed steels or carbide alloys, are coated with ceramics, such as metal carbides, metal nitrides or metal carbo-nitrides, by the PVD method in a lower temperature range of 250° to 550° C., has been found to be best.

(1) The pressure in the molding or coining or sizing is selected to be 0.5 to 6 t/cm$^2$.

(2) In particular, a thickness of an outside cylinder of a die is increased (an outside size of the products is preferably to be smaller than the thickness of an outside cylinder) so that the maximum stress at pressing when molded or coined or sized may be minimized. In addition, the punch is designed so as to withstand buckling stress.

(3) As to the alloyed tool steels, a material corresponding to SKD-11 is tempered at high temperatures. The high-speed steels are best.

(4) In order to maintain the adherence strength between the film and the mother metal, such as alloyed tool steels, high-speed steels or carbide alloys, the finishing surface roughness of the mother metal must be 1 S or less (S is defined in JIS B 0601-1982 Secs. 3.4, 3.4.3 and 3.4.3). In addition, a small radius R of 0.1 to 0.3 (R is defined in JIS Z 8317-1984 Sec. 6.3); must be given to end corners, and the like.

Thus, if merely the film-thickness previously set is incorporated into the preliminary treatment, the correction of size after the coating treatment becomes unnecessary and also the surface roughness is hardly changed even after the preliminary treatment, so that the luster finishing, such as lapping, is not required, whereby additional effects, such as (1) the reduction of processing cost, (2) the reduction of lead time and (3) the maintenance of the constant film-thickness all over the metal mold due to the absence of processings after the coating treatment, also can be exhibited in addition to the effect of increasing the life of the metal mold.

In addition, although metal carbides, metal nitrides, metal carbo-nitrides and the like are used as ceramics in the present invention, in particular TiC, TiN and TiCN give the best result.

In addition, in the case of for example a metal mold colored in gold by TiN, if it is required to control the micro wear which is difficult to be checked by the measurement of size, it is also possible to carry out the check by observing the changing condition of color.

PREFERRED EMBODIMENTS

The preferred embodiments of the present invention will be below described with reference to the drawings.

EXAMPLE 1

An inside surface 1 of a metal mold A for use in an involute gear (a pitch circle diameter: 80$\phi$, a module: 2, a number of teeth: 40) formed of a high-speed steel (SKH-9) and having a shape as shown in FIG. 1 showing a perspective view was coated with a TiN film of 3 microns thick at 500° C. by the PVD method.

An involute gear was molded by the use of the thus obtained metal mold of which inside surface was coated with TiN. The life of the metal mold could be increased about 5 times, that is, from 30,000 pieces by the conventional metal mold to 150,000 pieces.

EXAMPLE 2

An outside surface of a blade portion 3 of a blade type thin-walled core B formed of a high-speed steel (SKH-9) having a width of 2 mm and a length of 30 mm was coated with a TiCN film of 2.5 microns thick by the PVD method in the same manner as in EXAMPLE 1 at 350° C. The life of the resulting metal mold could be increased about 6 times or more, that is, from 25,000 pieces by the conventional metal mold to 150,000 pieces or more.

EXAMPLE 3

Figure 3:
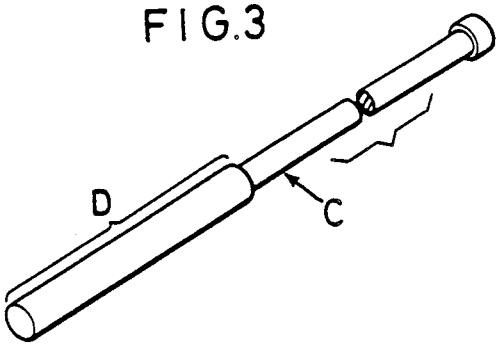
Figure 4:
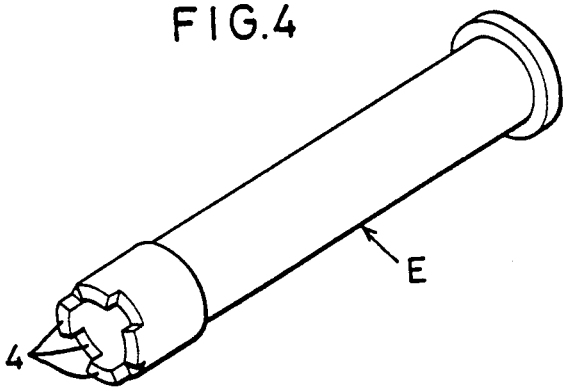

An outside surface of 200 mm long of a pointed end portion D of a core C for use in a pipe formed of a high-speed steel (SKH-9) having a diameter of 6 mm and a length of 500 mm, as shown in FIG. 3, was coated with a TiC film of 3 microns thickness by the PVD method in the same manner as in EXAMPLE 1 at 500° C.

The use of the resulting core for use in a pipe led to the possibility of molding or coining or sizing in a pipe-like shape.

In addition, even those having a whole length outside diameter ratio of 5 or more became easy to eject and the molded product did not generate abnormal cracks and did not exhibit any large variation of the length.

EXAMPLE 4

An uneven end face of a punch E made of carbide alloys, of which end face 4 is uneven, was coated with a TiC film of 2.5 microns thick by the PVD method in the same manner as in EXAMPLE 1 at 550° C. The use of the resulting punch in molding or coining led to the unnecessity of the micro correction, such as the repeated lapping, which has been required for the conventional punch, and gave the remarkably excellent releasability.

EFFECTS OF THE INVENTION

As above described in detail, the inside and outside wall surfaces and the end faces of a die, punch, core and the like made of alloyed tool steels, high-speed steels or carbide alloys are coated with a ceramic film in the present invention, so that the following excellent effects can be exhibited;

(1) A metal mold complicated in shape is apt to exhibit the sticking between the product and the walls thereof when molded or coined or sized from in particular iron series of powder also in view of the engagement thereof, and the higher the density of the product is, the shorter the sticking time becomes. And, this acts as a trigger to lead to wear, and tear of the metal mold. However, the use of the metal mold coated with ceramics according to the present invention led to no sticking.

Accordingly, the time of turning from the sticking to the wear was remarkably prolonged. That is to say, the life of the metal mold was increased 5 times or more in comparison with that of the conventional metal mold.

(2) In the case where the end faces of the upper and lower punches are uneven, the releasability of the product from the punches was remarkably inferior but the use of the punch according to the present invention led to a remarkable improvement of releasability.

(3) The ejection force for the cylindrical product having a whole length/outside diameter ratio of 5 or more, for which the ejection force is remarkably high, could be reduced.

(4) The sticking wear of the blade provided with a narrow groove when molded or coined or sized could be remarkably reduced, and the like.

I claim:

1. A metal mold for forming tools for powder metal parts, said mold being formed of alloyed tool steels, said mold having substantially concentric inner and outer surfaces and a castellated top surface connecting said inner and outer surfaces, said castellated top surface defining protrusions with end corners, wherein said inner and outer surfaces and said end corners of said metal mold are coated with a ceramic selected from the group consisting of Ti carbide, Ti nitride and Ti carbonitride by a PVD method to improve the abrasion resistance of said metal mold and wherein the finishing surface roughness of said inner and outer surfaces of said mold to which said coating is applied is 1 S or less and a radius R=0.1 to 0.3 mm. is given to said end corners of said metal mold to which said coating is applied to provide adhesion between the alloyed tool steel and the ceramic coating.

2. A metal mold for forming tools for powder metal parts, said mold being formed of high-speed steels, said mold having substantially concentric inner and outer surfaces and a castellated top surface connecting said inner and outer surfaces, said castellated top surface defining protrusions with end corners, wherein said inner and outer surfaces and said end corners of said metal mold are coated with a ceramic selected from the group consisting of Ti carbide, Ti nitride and Ti carbonitride by a PVD method to improve the abrasion resistance of said metal mold and wherein the finishing surface roughness of said inner and outer surfaces of said mold to which said coating is applied is 1 S or less and a radius R=0.1 to 0.3 mm. is given to said end corners of said metal mold to which said coating is applied to provide adhesion between the high-speed steel and the ceramic coating.

3. A metal mold for forming tools for powder metal parts, said mold being formed of carbide alloys, said mold having substantially concentric inner and outer surfaces and a castellated top surface connecting said inner and outer surfaces, said castellated top surface defining protrusions with end corners, wherein said inner and outer surfaces and said end corners of said metal mold are coated with a ceramic selected from the group consisting of Ti carbide, Ti nitride and Ti carbonitride by a PVD method to improve the abrasion resistance of said metal mold and wherein the finishing surface roughness of said inner and outer surfaces of said mold to which said coating is applied is 1 S or less and a radius R=0.1 to 0.3 mm. is given to said end corners of said metal mold to which said coating is applied to provide adhesion between the carbide alloy and the ceramic coating.

* * * * *